United States Patent [19]

Lufkin

[11] Patent Number: 4,899,847

[45] Date of Patent: Feb. 13, 1990

[54] MOBILE SUPPORTS

[76] Inventor: Elmer S. Lufkin, 233 E. Grove St., Middleboro, Mass. 02346

[21] Appl. No.: 341,969

[22] Filed: Apr. 24, 1989

Related U.S. Application Data

[63] Continuation-in-part of Ser. No. 128,940, Jan. 25, 1988, abandoned.

[51] Int. Cl.[4] ..... E06C 5/00; E06C 5/32; E06C 7/14

[52] U.S. Cl. ..... 182/13; 182/39; 182/129; 182/145; 248/210

[58] Field of Search ..... 182/12, 36, 39, 129, 182/13, 145; 248/238, 210

[56] References Cited

U.S. PATENT DOCUMENTS

| | | | |
|---|---|---|---|
| 1,142,806 | 6/1915 | Fenton | 182/13 |
| 2,597,756 | 5/1951 | Sitek | 248/238 |
| 2,902,110 | 9/1959 | Eickholdt | 182/36 |
| 2,908,345 | 10/1959 | Lund | 248/238 |
| 3,340,960 | 9/1967 | Wilson | 182/12 |
| 3,448,956 | 6/1969 | Kuhaneck, Jr. | 248/210 |
| 3,738,601 | 6/1973 | Gehringer | 248/210 |
| 4,480,810 | 11/1984 | Hall | 248/238 |
| 4,662,476 | 5/1987 | Ross | 182/13 |
| 4,706,918 | 11/1987 | Wilson | 182/129 |
| 4,730,802 | 3/1988 | Chatham | 182/129 |

*Primary Examiner*—Reinaldo P. Machado

[57] ABSTRACT

This invention is directed at a mobile ladder which has a two pairs of rollers. One pair of rollers moves in a first metal trough and the other pair moves in another metal trough. The metal trough are positioned close to a building wall, for example, and are in parallel relation to each other. The ladder can be moved in the troughs when a workman in on the ladder through use of a pulley system.

This invention is also directed at a mobile scaffold which has a two pairs of rollers. One pair of rollers moves in a first metal trough and the other pair moves in another metal trough. The metal trough are positioned close to a building wall, for example, and are in parallel relation to each other. The scaffold can be moved in the troughs when a workman in on the scaffold through use of a pulley system.

This invention is also directed at a work bucket that is mounted to a ladder by a pair of bracket members.

This invention is also directed at a work bucket assembly that is mounted to a ladder by a pair of bracket members engaged to a bar. The bar is attached to a pulley system which in turn is attached to a work bucket allowing the work bucket to be raised and lowered by a workman in the work bucket.

7 Claims, 3 Drawing Sheets

MOBILE SUPPORTS

This is a continuation-in-part of copending application Ser. No. 07/128,940 filed on Jan. 25, 1988 and now abandoned.

BACKGROUND OF THE INVENTION

Field of the Invention

This invention relates to mobile ladders and more specifically to mobile ladders having rollers which use a pulley system and a trough for moving the mobile ladder in relation to the work surface. It further relates to a scaffold which utilizes a similar combination of troughs, rollers and pulley system to move the scaffold in relation to the work surface. It also relates to a bucket element that will operate with the mobile ladder allowing a workman to be raised and lowered.

SUMMARY OF THE INVENTION

The invention disclosed herein is directed at a mobile ladder comprising an extension ladder having rollers which uses a pulley system and a pair of troughs within which the rollers move for moving the mobile ladder in relation to the work surface when one of the lines is pulled by the workman on the ladder. The invention also discloses a scaffold which utilizes a similar combination of troughs, rollers and pulley system to move the scaffold in relation to the work surface. A new bucket element is further disclosed that will operate with the mobile ladder allowing a workman to be raised and lowered by using a pulley system and an attaching means.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
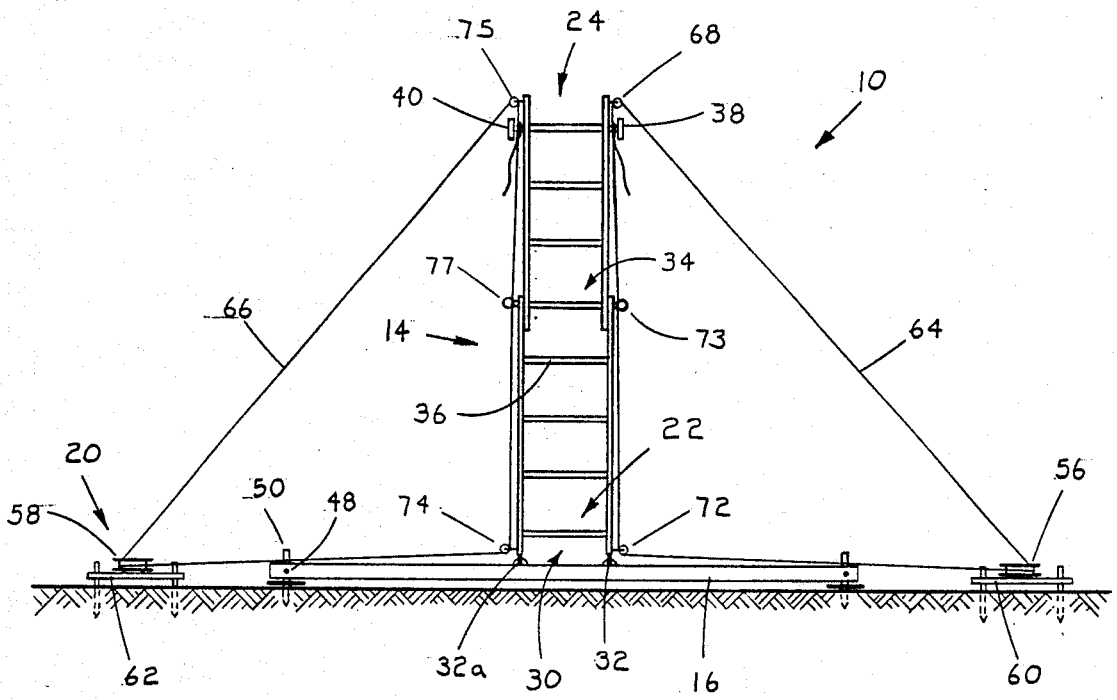
FIG. 1 is a front elevational view of the mobile ladder, a trough, the pulley system and method of staking same, according to the present invention.

There is shown in the drawings, the combination of a mobile ladder 10 and a wall surface 12. The mobile ladder 10 comprising an extension ladder 14, a first trough 16, an inner trough 18, and a pulley system 20.

The extension ladder 14 includes a bottom portion 22, a top or extension portion 24 and first and second adjustable support rods 26, 28. The bottom portion 22 has a lower terminal end 30 with a first roller 32 positioned on one side and a second roller **32*a* positioned on the other side. The bottom portion 22 has an upper terminal end 34 with the first adjustable support rod 26 extending from one side of a rung 36 at the upper terminal end 34 and with the second adjustable support rod 28 extending from other side of the rung 36. The first and second adjustable support rods 26, 28 are of telescopic construction for a purpose to be set forth hereinafter. Each of the first and second adjustable support rods 26, 28 includes a free terminal end having a roller element 29 attached thereto. A first cleat 38 extends outwardly from the right side piece of the top portion 24 in close proximity to the upper terminal end 34 and a second cleat 40 extends outwardly from the left side piece of the top portion 24 in close proximity to the upper terminal end 34. The top portion 24 of the mobile ladder 10 has an upper end. An adjustable rod 42 extends from one of the side pieces of the upper end of the top portion 24 of the ladder 14. The rod 42 has a free terminal end attached to a wall engagement roller 44. The right side piece of the upper end of the top portion 24 of the ladder 14 has a pail supporting bracket 46 extending therefrom below the rod 42**.

The first trough 16 comprises a rectangular body portion having two side walls extending upwardly from the side edges of a base and open at the top and at the ends. It is formed of ¼ inch treated aluminum which may be made ten to fifteen feet long. A through hole 48 is formed through each of the side walls of the first trough 16. The holes 48 are in alignment and are used to attach stakes 50, having spaced holes formed therethrough, to the first trough 16 as will be more fully setforth hereinafter.

The inner trough 18 comprises a rectangular body portion having two side walls extending upwardly from the side edges of a base and open at the top end at the ends. It is formed of ¼ inch treated aluminum which may be made ten to fifteen feet long. A through aperture 52 is formed through each of the side walls of the inner trough 18. The holes 52 are in alignment and are used to attach stakes 50 to the inner trough 18 as will be more setforth hereinafter.

Figure 2:
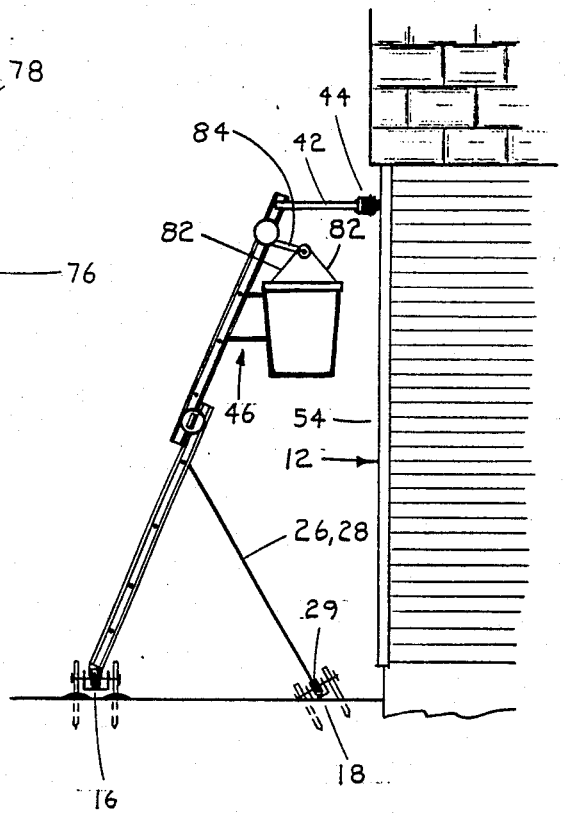
FIG. 2 is a perspective of the bucket for use with the mobile ladder shown in FIG. 1.
Figure 4:
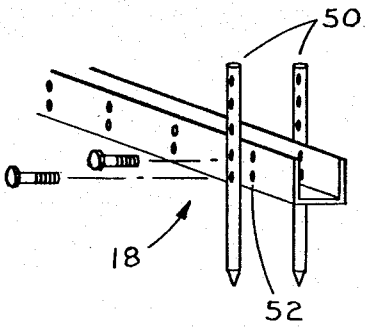
FIG. 4 is a perspective view of one method of staking the trough of the mobile ladder shown in FIG. 1.

In using the mobile ladder 10 for painting the wall 54 of a house, for example, the inner trough 18 is positioned a predetermined distance from the wall 54 of the house, three feet for example, and in parallel relation therewith and with the wall engagement roller 44 bearing against the wall 54. Two pair of stakes 50 are attached to the side walls in close proximity with each free open end of the inner trough 18 by bolting through a hole in the stake 50 and then through the aperture 52 on each of the walls as shown in FIG. 2 and FIG. 4. The stakes 50 are driven in at an angle to allow the first and second adjustable support rods 26, 28 to ride within the inner trough 18 at the appropriate angle. The first trough 16 is positioned in parallel relation with the wall 54 and the inner trough 18. The first trough 16 is positioned a predetermined distance from the wall 54, four feet for example. The method of staking is the same as for the inner trough 18 as setforth above. The stakes 50 are driven in so that the first and second rollers **32, 32*a* may be properly positioned in the first trough 16**. The pulley system 20 comprises a first sheave 56, a second sheave 58, a first block 60, a second block 62 and first and second lines 64, 66. The first sheave 56 is mounted in the first block 60 and this assembly is staked on the ground, spaced from the right terminal end, for example, of the first trough 16 and aligned therewith. The second sheave 58 is mounted in the second block 62 and this assembly is staked on the ground, spaced from the left terminal end for example, of the first trough 16 and aligned therewith, as shown in FIG. 1. The first line 64 is attached to the first cleat 38 and extends through a first roller component 68 positioned on the right side piece of the top portion 24 of the ladder 14 thence around the first sheave 56 to a second roller component 72 positioned on the right side piece of the bottom portion 24 of the ladder 14 to an intermediate roller compartment 73 positioned on the right side piece of the bottom portion 24 of the ladder 14 in close proximity to the upper terminal end 34. A free terminal end of the first line 64 is extended to the first cleat 38 and allowed to dangle therefrom along the right side piece of the top portion 24 of the ladder 14. The second line 66 is attached to the second cleat 40 and extends through a third roller component 75 positioned on the left side piece of the top portion 24 of the ladder 14 thence around the second sheave 58 to a fourth roller component 74 positioned on the left side piece of the bottom portion 22 of the ladder 14 to an intermediate roller component 77 positioned on the left side piece of the top portion 24 of the ladder 14. A free terminal end of the second line 66 is extended to the second cleat 40 and allowed to dangle therefrom along the left side piece of the top portion 24 of the ladder 14. If an operator wishes to move the ladder 14 to the right, he pulls on the free end of the first line 64; if he wishes to move to the left he pulls on the free end of the second line 66.

Figure 3:
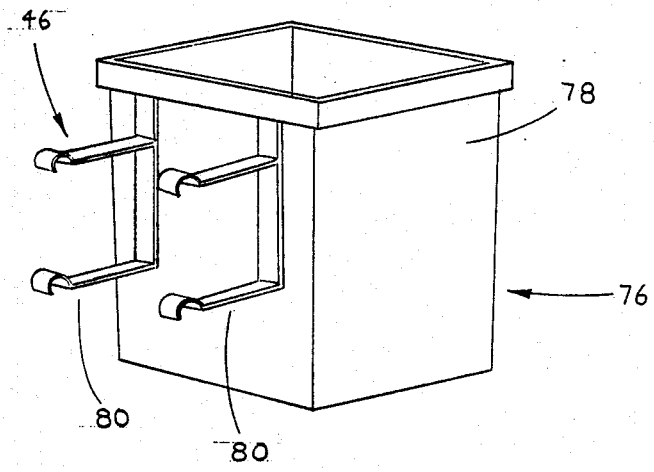
FIG. 3 is a side elevational view of the mobile ladder shown in FIG. 1, also showing the engagement of the bucket with the mobile ladder.

A bucket 76, for holding items the operator intends to use, is shown at FIG. 3. The bucket 76 comprises a rectangular body portion 78 formed of a plastic material, for example, and having a pair of brackets 80 extending from one side as shown. The brackets 80 include arms having acuate terminal ends to engage the rungs of the ladder 14. A hanger 82 may be attached to the top of the bucket 76 as shown in FIG. 2. The hanger 82 may be engaged to a bracket element 84 which extends from the right side piece of the top portion 24 of the ladder 14 to increase stability.

Figure 5:
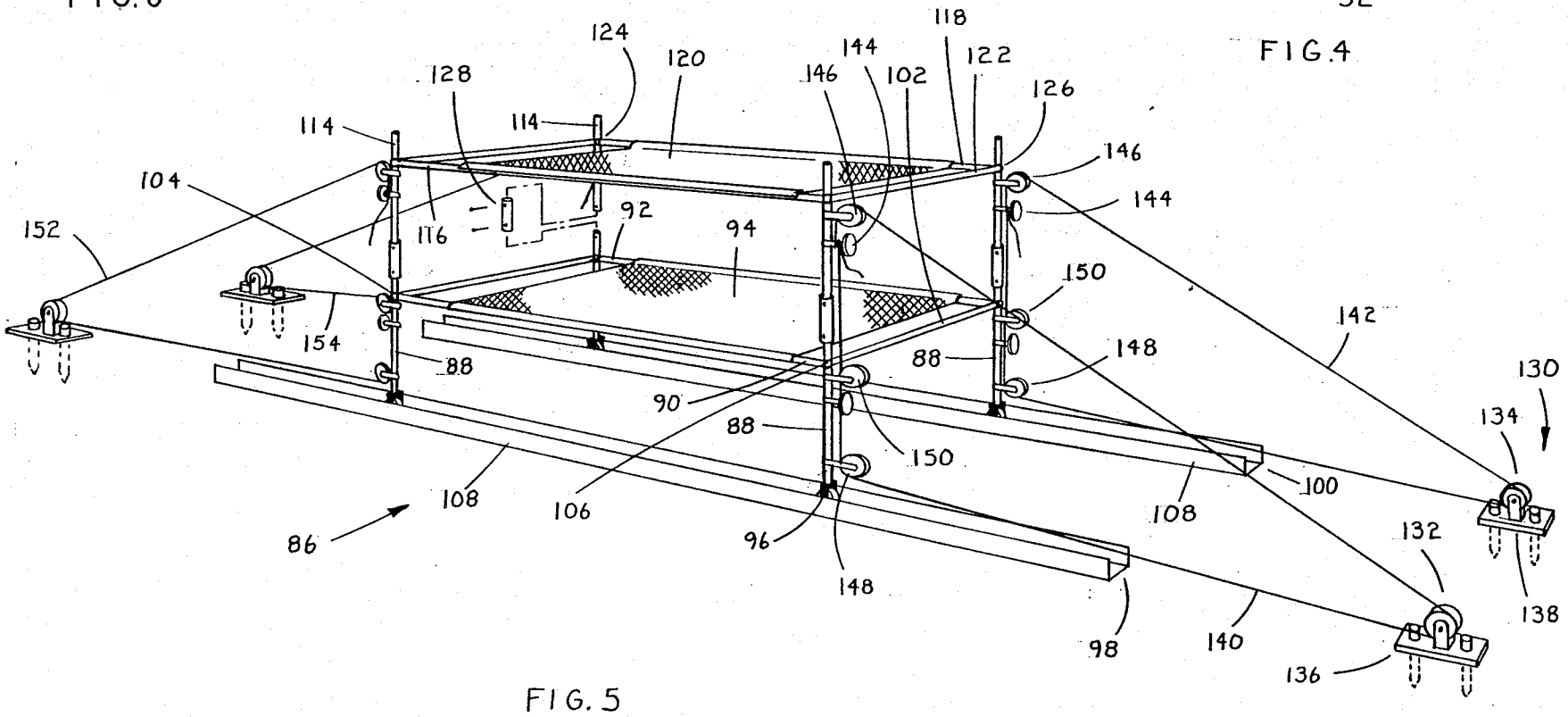
FIG. 5 is a perspective view of a mobile scaffold, a pair of troughs, the pulley system and method of staking same, according to the present invention.
Figure 6:
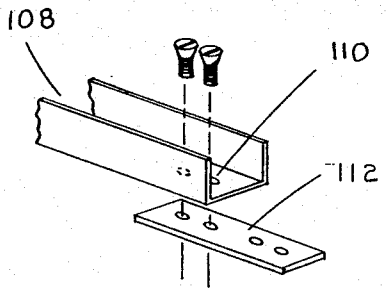
FIG. 6 is a perspective view of another method of staking the trough of the mobile ladder shown in FIG. 1.
Figure 8:
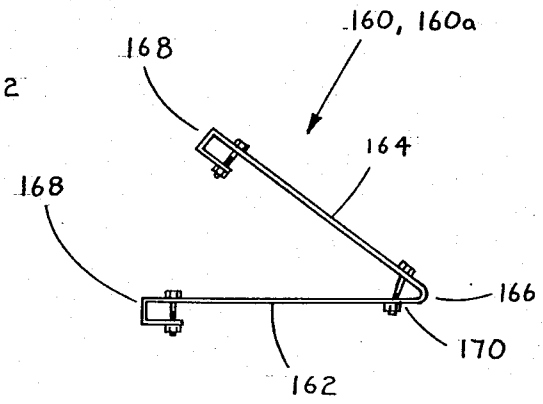
FIG. 8 is an enlarged side elevational view of one of the support brackets shown in FIG. 7.
Figure 7:
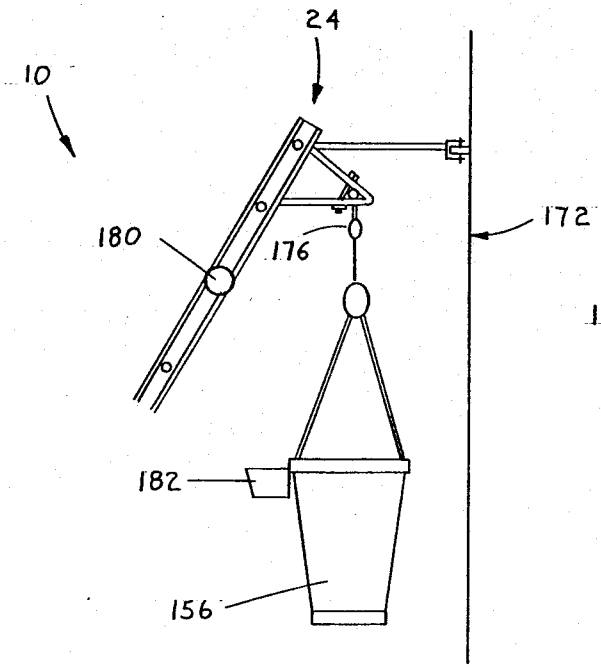
FIG. 7 is a side elevational view of a variation of the bucket in FIG. 1.

There is also shown in the drawing at FIG. 5 a scaffold 86 comprising a first set of four tubular base legs 88, a first support element 90, a second support element 92, a first platform 94 and a control bar 102. Each of the first and second support elements 90, 92 includes a first terminal end 104 and a second terminal end 106 each of which is attached to one of the tubular legs 88 as shown in FIG. 8. The platform 94 is attached to the first and second support elements 90, 92 providing a work area for workmen to stand and position their equipment. Each of the tubular legs 88 has a roller 96 attached at a terminal end as shown in FIG. 5. The scaffold 86 may be used with a pair of trough components 108. Each of the trough components 108 comprises a rectangular body portion having two side walls extending upwardly from the side edges of a base and open at the top and at the ends. they may be formed of ¾ inch treated aluminum which may be made ten to fifteen feet long. A pair of spaced, recessed, through holes 110 are formed in the base of each of the trough components 108 in close proximity to each of their terminal ends as indicated in FIG. 6. An apertured plate 112 is provided to be engaged by screws passed through holes 110 into internal threaded holes in the plate 112 as shown in FIG. 6. The plate 112 extends beyond the terminal ends of each of the trough components 108. This extended portion has through holes formed in it though which stakes may be passed to fix the trough components 108 to the ground. The scaffold 86 further comprising a set of four tubular extension legs 114, a third support element 116, a fourth support element 118, a second platform 120 and a second control bar 122. Each of the third and fourth support elements 116, 118 includes a primary terminal end 124 and a secondary terminal end 126 which is attached to one of the extension legs 114 as shown in FIG. 5. The second platform 120 is attached to the third and fourth support elements 116, 118 providing a work area for workmen to stand and position their equipment. Each of the extension legs 114 has an enlarged tubular portion 128 attached at a terminal end as shown in FIG. 5. Each of the enlarged tubular portions 128 is adapted to slide engage a free terminal end of the tubular legs 88 allowing the scaffold 86 to be utilized at a higher work position.

In using the scaffold 86 for painting the wall of a house, for example, the inner trough element 108 is positioned a predetermined distance from the wall of the house and in parallel relation therewith. The inner trough element 108 may be staked to the ground by using the stake assembly shown in FIG. 4 and as explained in the discussion concerning the inner trough 18 set forth hereinbefore. The other trough element 108 is positioned a predetermined distance from the wall of the house and in parallel relation with the wall and the inner trough element 108. The method of staking is the same as for the inner trough element 108 as setforth above. The stakes 50 are driven in so that the rollers 96 may be properly positioned in the trough element 108. A pulley system 130 is used to move the scaffold 86. The pulley system 130 comprises a primary sheave 132, a secondary sheave 134, a primary block 136, a secondary block 138 and first and second lines 140, 142. The primary sheave 132 is mounted in the primary block 136 and this assembly is staked on the ground, spaced from the right side end for example, of the first trough element 98 and aligned therewith. The secondary sheave 134 is mounted in the secondary block 138 and this assembly is staked on the ground, spaced from the right terminal end for example, of the second trough element 100 and aligned therewith, as shown in FIG. 5. The first line 140 is attached to a primary cleat 144 which is attached to each of the extension legs 114, as shown in FIG. 5. The first line 140 then extends through a primary pulley component 146 positioned on each of the extension legs 114, as shown in FIG. 8 thence around the primary sheave 132 to a secondary pulley component 148 positioned on each of the base legs 88, as shown in FIG. 8 to a third pulley component 150 positioned on each of the base legs 88, as shown in FIG. 8 and then back to the primary cleat 144. The second line 142 is attached to the primary cleat 144 which is mounted on the right extension leg 114, as shown in FIG. 8. The second line 142 then extends through the primary pulley component 146 positioned on the right extension leg 114, as shown in FIG. 8 thence around the secondary sheave 134 to the secondary pulley component 148 positioned on each of the base legs 88, as shown in FIG. 8 to a third roller component 150 positioned on each of the base legs 88, as shown in FIG. 8 and then back to the primary cleat 144. The left side of the scaffold 86 is rigged the same as the right side as setforth hereinbefore, using third and fourth lines 152, 154. If an operator wishes to move the scaffold 86 to the right, he pulls on the free ends of the first and second lines 140, 142; if he wishes to move to the left he pulls on the free end of the third and fourth lines 152, 154.

Figure 9:
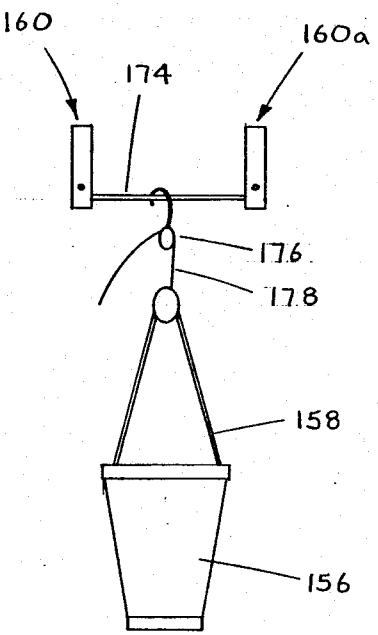
FIG. 9 is an enlarged elevational view showing the engagement between the bar and the bucket variation shown in FIG. 1.

A variation of the bucket 76 is shown in FIG. 9 and comprises a bucket element 156 which is constructed to hold a workman. The rim of the bucket element 156 has a support line 158 which extends loosely across the opening defined by the rim. To engage the bucket element 156 to the top portion 24 of the ladder 10 a pair of support brackets **160, 160*a* are utilized. Each of the support brackets 160, 160*a* comprise a bottom leg 162 and a top leg 164. The top leg 164 is in angular relation to the bottom leg 162 and integral with it at an apex 166. The free terminal ends of the top and bottoms legs 164, 162 include integral clamping members 168. The top and bottoms legs 164, 162 each have a through hole 170 formed therein in close proximity to and spaced from the apex 166. One of the support brackets 160 is mounted on the right side top portion 24 of the ladder 10 by engaging the upper clamping member 168 to the top rung of the ladder 10 and the lower clamping member 168 to the next rung of the ladder 10. A similar engagement on the left side of the ladder 10 is made with the other support bracket 160*a*. In this position the two support brackets 160, 160*a* extend below the ladder 10 and toward a building wall 172, for example, when the ladder is being used. The two support brackets 160, 160*a* are in spaced parallel relation with each under and a support bar 174 can be set from one to the other with the terminal ends of the bar positioned in the apices 166. A combination hook and clam shell pulley, snatch block 176 is engaged to the support bar 174 by hooking the hook of the snatch block over it. A line 178 can then be attached to the support line 158 of the bucket element 156 and then through the pulley of the snatch block 176 permitting a workman in the bucket element 156 to raise and lower himself by pulling or releasing the line 178. Cleats 180 may be positioned on along the right rail of the ladder 10 to allow the line 178 of the bucket element 156 to be tied of when it is in position. A cup element 182 can be attached to the rim of the bucket element 156 for holding items used by the workman. The workman in the bucket element 156 can move the ladder 10 through the troughs 16, 18 by using the pulley system 20** as explained heretofore.

What I claim is:

1. The combination of a mobile ladder and a surface, the mobile ladder comprising a ladder, a trough, an inner trough, and a pulley system, the ladder including a bottom portion, a top portion and a first adjustable support rod, the bottom portion having a first roller and the pulley system associated therewith, the first adjustable support rod having a free terminal end, associated with the ladder and the free terminal end having a third roller engaged therewith, the trough and the inner trough in spaced, substantially parallel relationship with each other and both positioned on the surface, the first roller movably associated with the trough and the third roller movably associated with the inner trough, whereby activation of the pulley system moves the first roller within the trough and the third roller within the inner trough.

2. The combination of a mobile ladder and a surface as set forth in claim 1 wherein the pulley system comprises a first sheave, a second sheave, a first block and a second block, the first sheave mounted in the first block, the second sheave mounted in the second block, the first and second blocks engaged with the surface, spaced from and aligned with the trough.

3. The combination of a mobile ladder and a surface as set forth in claim 1 wherein the top portion of the ladder includes first and second runners, each of the runners having an end, a support element extending from each of the runners adjacent its end, one of the support elements having a fifth roller associated therewith and the other support element having a sixth roller associated therewith.

4. The combination of a mobile ladder and a surface as set forth in claim 1 wherein the bottom portion of the ladder includes third and fourth runners, the first adjustable support rod element extending from the third runner, a second adjustable support rod element extending from the fourth runner, the second adjustable support rod element having a free terminal end, the free terminal end of the second adjustable support rod element having a fourth roller engaged therewith, the third runner having a first foot and the fourth runner having a second foot, the first roller associated with the first foot, a second roller associated with the second foot, the first and second rollers movably associated with the trough, the third and fourth rollers movably associated with the inner trough, whereby activation of the pulley system moves the first and second rollers within the trough and the third and fourth rollers within the inner trough.

5. A mobile scaffold comprising a first set of base legs, a first platform assembly, a first trough, an inner trough, and a pulley system, the first platform assembly having a first platform portion, the first platform portion having four attachment positions, each of the attachment positions formed at corner of the first platform portion, a base leg engaged to each of the attachment positions, the first set of base legs including a first base leg, a second base leg, a third base leg and a fourth base leg, the first, second, third and fourth base legs each having a terminal end, the first platform portion having a first side and a second side, the first and second base legs positioned on the first side of the first platform portion in spaced alignment with each other, the third and fourth base legs positioned on the second side of the first platform portion in spaced alignment with each other, a roller attached to the terminal end of each of the first, second, third and fourth base legs, the first trough and the inner trough in spaced, substantially parallel relationship with each other and both positioned on a surface, the rollers of the first and second base legs movably associated with the first trough and the rollers of the third and fourth base legs movably associated with the inner trough, whereby activation of the pulley system moves the rollers of the first and second base legs within the first trough and the rollers of the third and fourth base legs within the inner trough.

6. A work bucket for use with a ladder, the bucket comprising a body portion, the body portion having a holding cavity and having a side, first and second bracket elements extending from the side, each of the bracket elements including first and second arms, each of the arms having an acuate terminal end to engage the rungs of a ladder, the first and second bracket elements in spaced parallel relation to each other.

7. A work bucket assembly for use with a ladder, the bucket assembly comprising a bucket element which is constructed to hold a workman, the bucket element includes a rim, the rim defining an opening, a support line extending across the opening defined by the rim, a pair of support brackets, each of the support brackets comprising a bottom leg and a top leg, the top leg is angular relation to the bottom leg and integral with it at an apex, the bottom and top leg each having terminal ends remote from the apex, the terminal ends including integral clamping members, the top and bottoms legs each having a through hole formed therein in close proximity to and spaced from the apex, one of the support brackets adapted to be mounted on the right side top portion of a ladder by engaging one of the clamping members to the top rung of the ladder and engaging the other clamping member to the next rung of the ladder, a similar engagement on the left side of the ladder may be made with the other support bracket, in this position the two support brackets extend below the ladder and toward a building wall, when the ladder is being used, the two support brackets are in spaced parallel relation with each under and a support bar can be set from one to the other in the apices, a pulley means is engaged in the support bar, a line can then be attached to the support line of the bucket element and then through the pulley means permitting a workman in the bucket element to raise and lower himself by pulling or releasing the line.

* * * * *